United States Patent [19]

Gerretz et al.

[11] Patent Number: 5,022,250

[45] Date of Patent: Jun. 11, 1991

[54] METHOD OF PILGRIM STEP ROLLING

[75] Inventors: Josef Gerretz, Viersen; Horst Stinnertz, Willich, both of Fed. Rep. of Germany

[73] Assignee: Mannesmann AG, Düsseldorf, Fed. Rep. of Germany

[21] Appl. No.: 170,283

[22] Filed: Mar. 18, 1988

[30] Foreign Application Priority Data

Mar. 18, 1987 [DE] Fed. Rep. of Germany ..... 3708943

[51] Int. Cl.[5] ..... B21D 7/00

[52] U.S. Cl. ..... 72/214; 72/208; 72/209; 72/214

[58] Field of Search ..... 72/208, 209, 214

[56] References Cited

U.S. PATENT DOCUMENTS

| | | | |
|---|---|---|---|
| 3,698,225 | 10/1972 | Peytavin | 72/208 |
| 3,862,560 | 1/1975 | Grinshpun et al. | 72/208 |
| 4,005,595 | 2/1977 | Gerretz et al. | 72/208 |
| 4,145,906 | 3/1979 | Makarkin et al. | 72/208 |
| 4,184,352 | 1/1980 | Potapov et al. | 72/214 |
| 4,186,585 | 2/1980 | Passoni et al. | 72/208 |
| 4,541,262 | 9/1985 | Peytavin | 72/214 |
| 4,641,513 | 2/1987 | Peytavin | 72/208 |

*Primary Examiner*— Goldberg
*Assistant Examiner*—I. Cuda
*Attorney, Agent, or Firm*—Spencer & Frank

[57] ABSTRACT

A method of pilgrim step rolling of elongated stock includes reciprocating a roll stand or frame for moving the stock either by rotating it and/or advancing it; such a method is improved by providing a first component of movement at a constant speed and adding thereto, near each dead center portion of the reciprocating frame movement, a second component of motion including temporary accelerating and decelerating periods.

2 Claims, 5 Drawing Sheets

PRIOR ART Fig.3

METHOD OF PILGRIM STEP ROLLING

BACKGROUND OF THE INVENTION

The present invention relates to a so-called pilgrim step rolling which is a method using basically a reciprocating roll stand for advancing and reducing the item being. More particularly the invention relates to advancing and rotating rolls used for the pilgrim step rolling of tubes, rods or the like; a cold rolling method is being preferred. The rolled stock is either turned or advanced or both in a dead center of the path of reciprocation of the roll stand.

The pilgrim step cold rolling method and equipment is known wherein generally, during rolling, the frame and roll mount reciprocates. The stock e.g. a tube or pipe is turned and/or advanced in one or both dead center positions of the reciprocating frame. Thus during most of the rolling procedure the stock is basically at rest vis-a-vis the frame as well as in relation to roll axes. The known methods are disadvantageous in that the torque required for turning the stock is to be developed within a short period of time. These acceleration moments set limits for the power performance of the cold rolling pilgrim step method.

In order to obviate these drawbacks, methods and equipment have been suggested to eliminate the acceleration and to provide for rotation of the stock as well as for advancing it at a constant rate. Unfortunately these methods are usable to a limited extent only since a part of the rotation of the rolled stock which occurs in between period of engagement of the rolled stock itself and the rolls, is stored elastic energy. This storage of elastic energy when released does produce a torque. However this torque has to be developed and applied basically by friction between the rolled stock and the clamping elements which are provided for holding that stock. The situation is quite similar as far as advance is concerned. In case the advance is rapid, there is a particular limit given by the elastic properties of the advancing equipment on one hand and the rolls in conjunction with the mandrel on the other hand.

SUMMARY OF THE INVENTION

It is an object of the present invention to improve the method outlined above, particularly involving cold rolling such that the advantages of the known methods generally are retained but the drawbacks and disadvantages can be overcome.

In accordance with the preferred embodiment of the present invention it is suggested to impart an advance movement and/or a rotation upon the rolled stock in two components. During each cycle of reciprocating frame and roll stand movement a constant movement component is applied (advance or rotation) while a residual discontinuous movement component is superimposed upon the constant movement and is predominantly developed in or near the dead center points of the roll stand or frame. Preferably the discontinuous movement is provided by the application of a linearly rising and lowering of the speed to and from a maximum speed. This holds true for turning as well as for advancing as the case may be. The supplemental component of motion is upon the rolled stock primarily or exclusively within those periods of the workcycle in which the rolled stock is not in engagement with the rolls.

Owing to the constant advance of the rolled stock the apex speeds are limited during frame dead center movements. Now it is made possible to reduce the large accelerating moments that would be necessary otherwise, but the advantages of having acceleration in certain parts of the movement is retained. The result of this approach is that the speed and accelerating maxima can be lowered as compared with prior art practice. This way the power performance of the pilgrim step method and its equipment is improved in a simple fashion.

Preferably both any rotation and any advance of the stock is effected by hydromotors or electromotors, whose speed may be varied having readily available and adjustable speed features. Drives of this type are known per se but they offer an advantage owing to a high degree of adaptability to the requirements of the rolling process according to the invention. In particular long oscillation sensitive force transition elements can be avoided.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DESCRIPTION OF THE PREFERRED EMBODIMENTS

Figure 1:
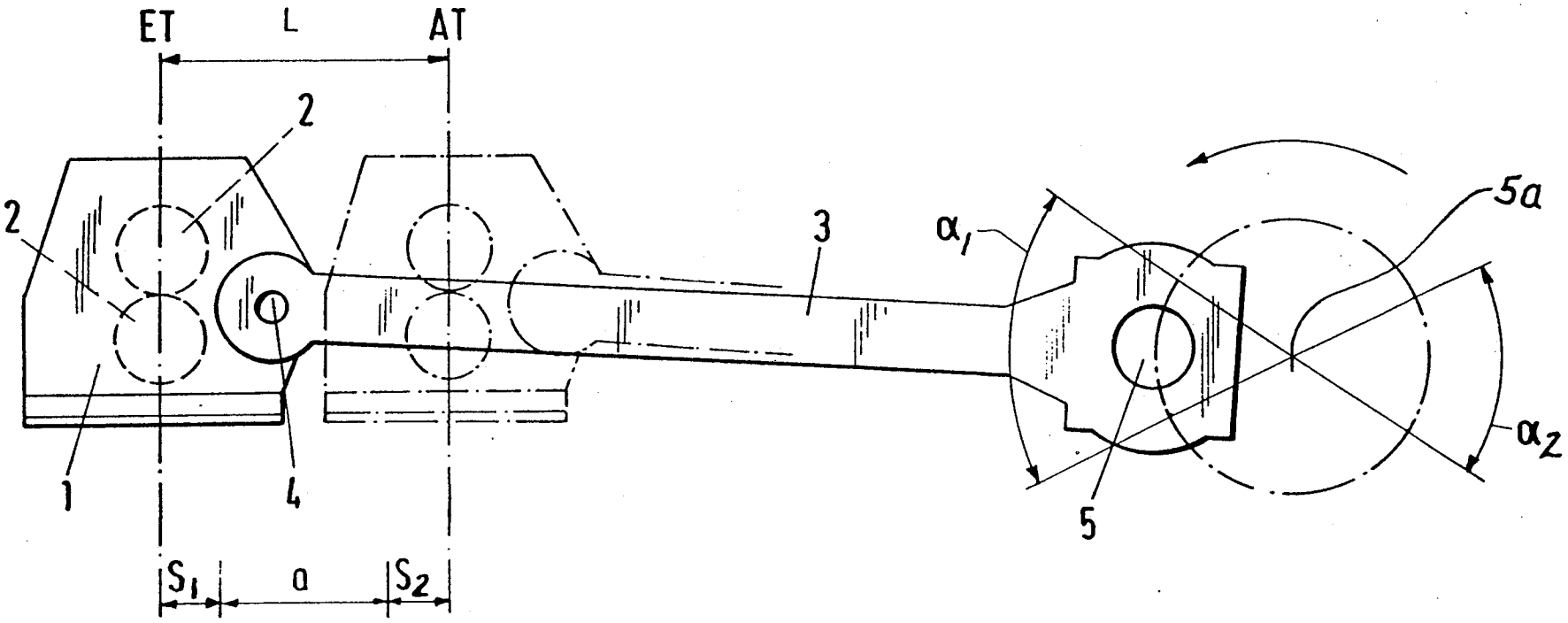
FIG. 1 is a side view showing a conventional drive for a pilgrim step process.

Proceeding to the detailed description of the drawings, FIG. 1 shows a known drive for cold pilgrim step rolling, using specifically a crank drive. The frame 1 supports the rolls 2 for the pilgrim step rolling. The frame 1 is driven by a crank 3 which is linked at a point 4 to the frame or stand 1. The crank 3 itself is mounted on a crank shaft 5 being rotated about a center 5*a*.

By means of the crank 3 frame 1 can be shifted (reciprocated) from the solid-line position to the phantom-line position. The angular ranges a1 and a2 correspond to the crank displacement length ranges S1 and S2, wherein the stock being rolled is disengaged from the rolls 2. Here then the stock can be rotated as well as advanced. For a length L−(S1+S2) rolling takes place, during which in the conventional pilgrim step method the stock is neither rotated nor advanced.

Figure 2:
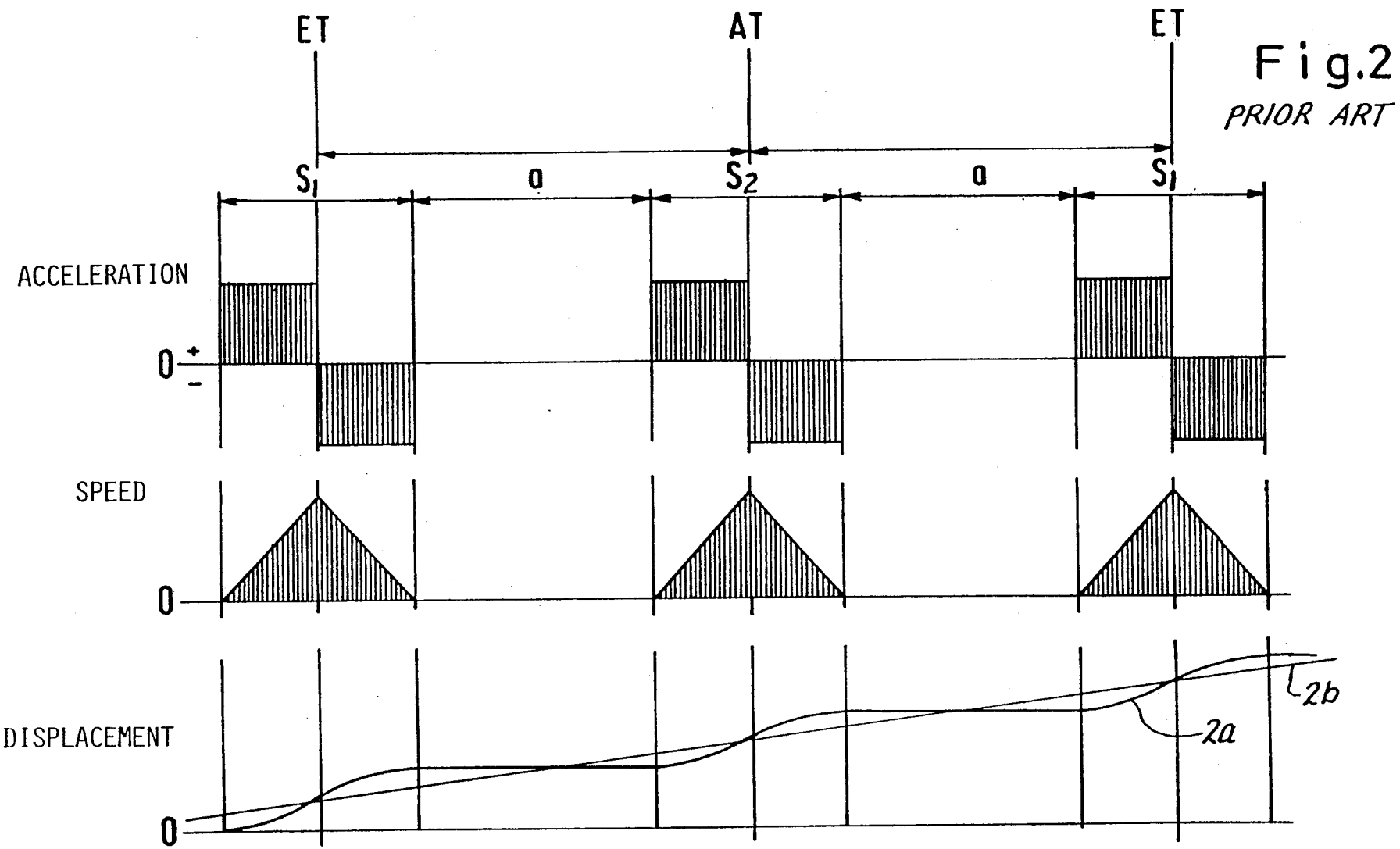
Fig.2 PRIOR ART
FIG. 2 is a diagram illustrating displacement, speed and acceleration functions of a prior art process.

Turning to FIG. 2, the lowest diagram shows cumulatively the rotation and/or linear displacement of the rolled stock. The line 2*a* denotes instantaneous cumulative displacement values while 2*b* is the average displacement. During the same time crank 3 rotates at constant speed. From the point of view of diagram illustration, rotation and advancement are equivalent situation; only the ordinate scale is different (length, angle). The abscissa is time in either instance. The middle diagram of FIG. 2 shows speed of the stock and the upper diagram shows acceleration of the stock.

Figure 3:
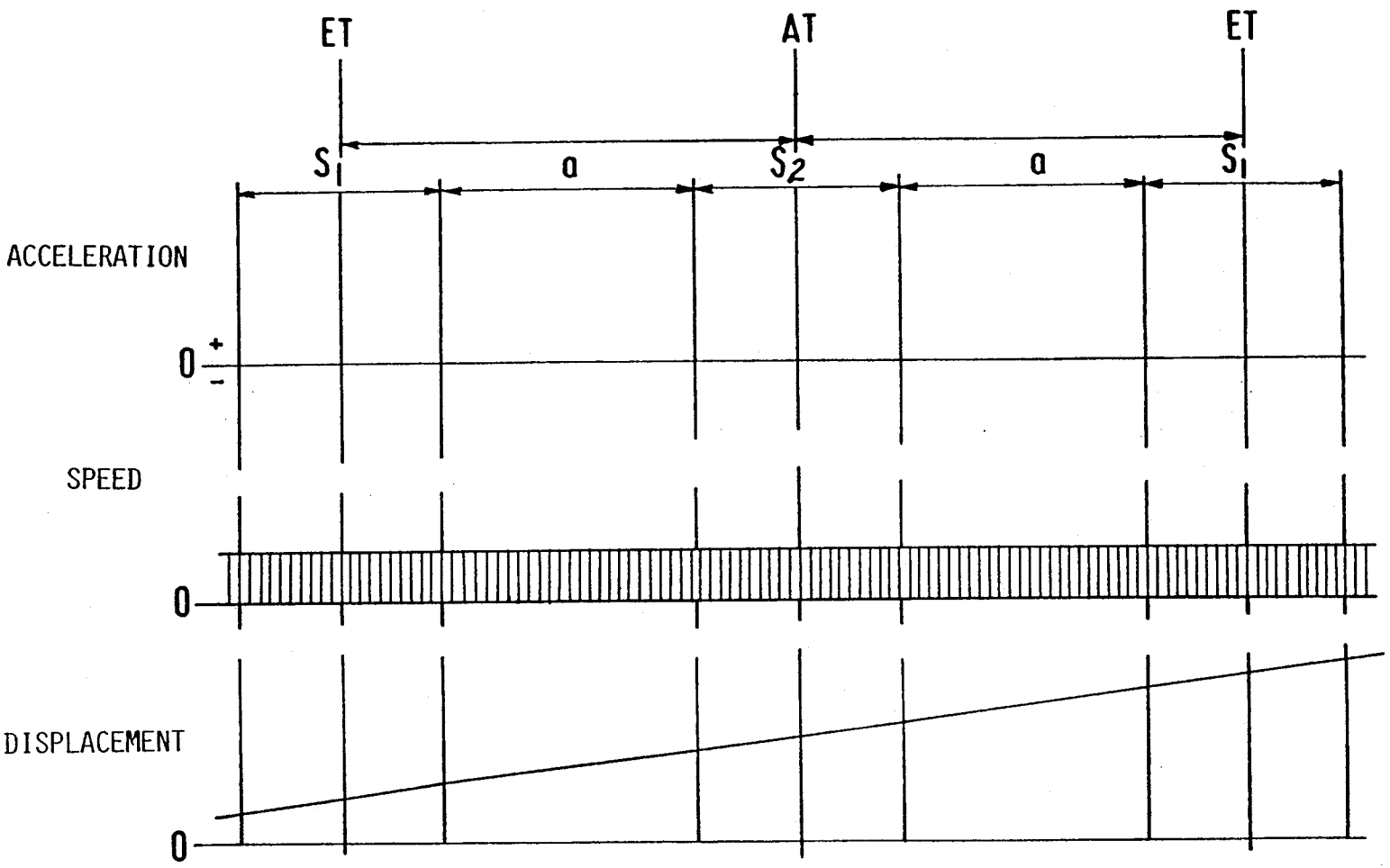
FIG. 3 is a diagram illustrating displacement, speed and acceleration functions of another prior art process.

FIG. 3 illustrates prior art practice of constant speed advance and/or rotation. The acceleration is zero in this case, the speed (middle diagram) is constant and the displacement (length or angular) rises linearly.

Figure 4:
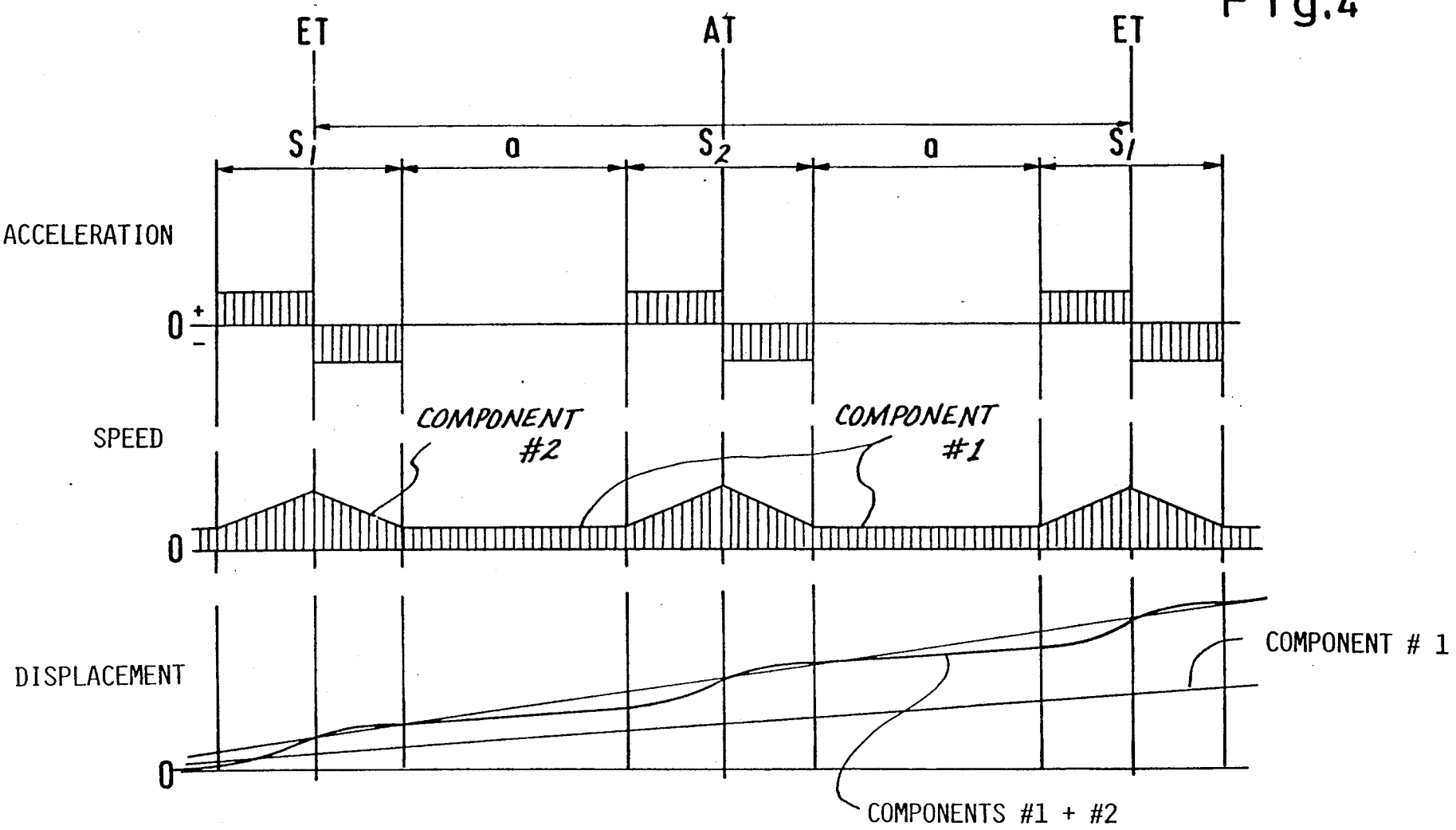
FIG. 4 is a diagram illustrating displacement, speed and acceleration functions of a preferred embodiment of the invention.

Turning to FIG. 4, in accordance with the present invention, it is suggested to provide one portion of the requisite rotation and/or advance movement as a constant-speed, first motion component #1 throughout the entire cycle, while a remaining portion is provided as a varying-speed, second motion component #2 which is provided in interspersed ranges S1 and S2 around the respective dead center portion of reciprocating movement of the frame. Equipment suitable for carrying out this method is shown in my copending application Ser. No. 170,284, filed 03/18/1988 of common assignee. In the embodiment according to FIG. 4 the second motion component #2 is exclusively provided in the ranges S1 and S2 around the dead center position. One can see by comparison with FIG. 2 that the maxima for speed as well as acceleration are reduced considerably. This is present always due to the fact that there is a relatively low constant speed component present.

Figure 5:
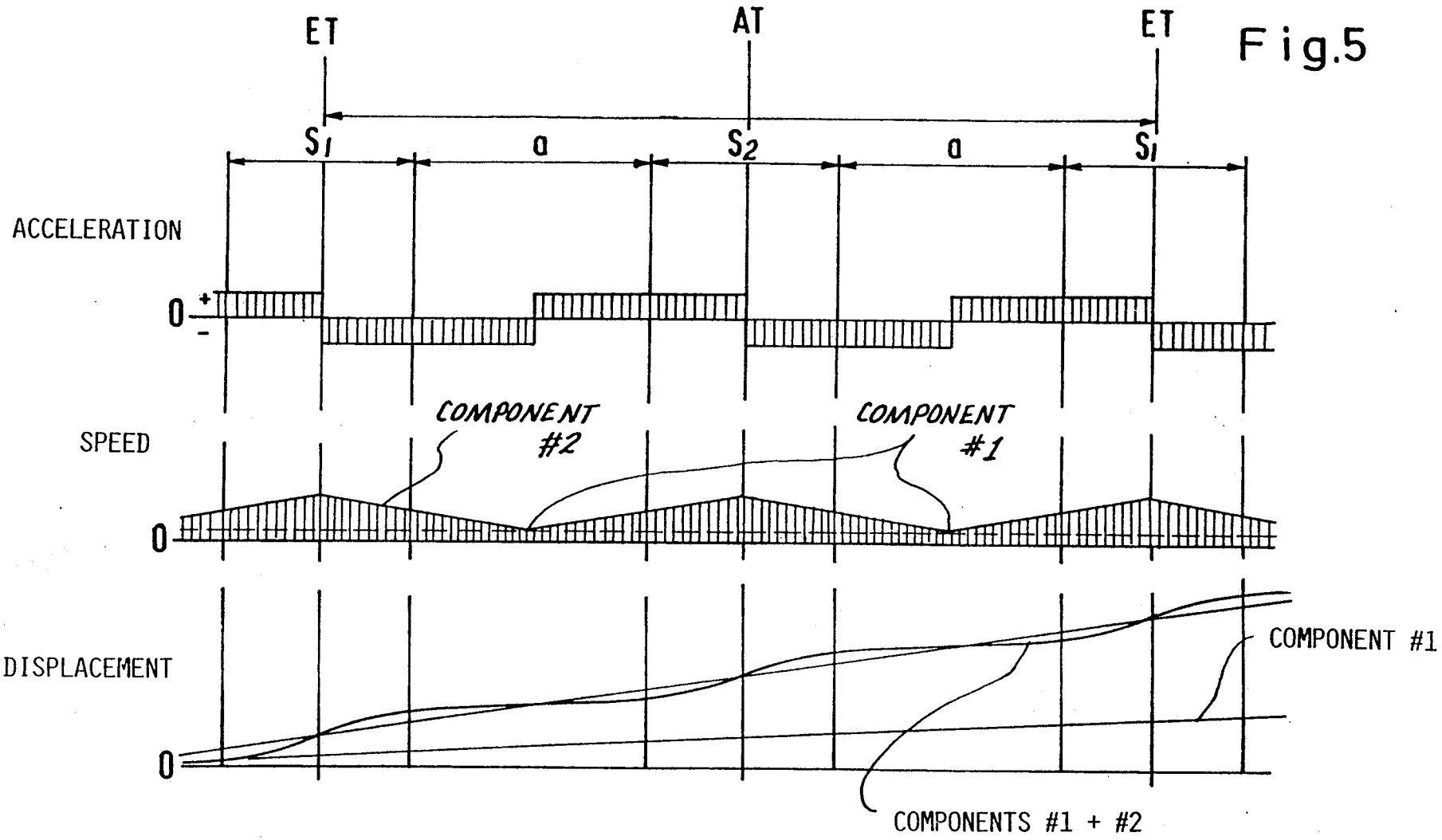
FIG. 5 is a diagram illustrating displacement, speed and acceleration functions of another preferred embodiment of the invention.

Further reduction of the peak speed values is obtained when the discontinuous superimposed second motion component #2 actually extends beyond the ranges S1 and S2, as shown in FIG. 5. The ranges S1 and S2 are shown for reasons of symmetry to be of equal magnitude but they are in fact independently selectable as far as duration is concerned. In either case, the stock being rolled is not in contact with the rolls 2 during maximum-speed turning and/or advancing.

The invention is not limited to the embodiments described above but all changes and modifications thereof, not constituting departures from the spirit and scope of the invention, are intended to be included.

We claim:

1. In a method of pilgrim step rolling of elongated stock, including the steps of imparting an advancing or rotating motion to the stock by a roll stand reciprocating in cycles along a path between two dead center positions and rolling the stock by rolls mounted in the roll stand; the improvement wherein the step of imparting motion comprises the steps of applying a first motion component of constant speed to the stock throughout each reciprocating cycle; and superposing a second motion component of varying speed on the first motion component preponderantly along path zones adjoining each dead center position.

2. A method as defined in claim 1, wherein the step of applying a second motion component comprises the step of alternately accelerating and decelerating the stock at a constant rate such that speed maxima occur in said path zones; further comprising the step of maintaining the stock out of contact with said rolls in said path zones.

* * * * *